US008150295B2

(12) United States Patent
Nakamura et al.

(10) Patent No.: US 8,150,295 B2
(45) Date of Patent: Apr. 3, 2012

(54) CHARGING MEMBER, CHARGING DEVICE INCLUDING THE CHARGING MEMBER, PROCESS CARTRIDGE INCLUDING THE CHARGING DEVICE AND IMAGE FORMING APPARATUS INCLUDING THE PROCESS CARTRIDGE

(75) Inventors: Makoto Nakamura, Ebina (JP); Yutaka Narita, Sagamihara (JP); Tadayuki Oshima, Atsugi (JP); Taisuke Tokuwaki, Sagamihara (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 394 days.

(21) Appl. No.: 12/426,568

(22) Filed: Apr. 20, 2009

(65) Prior Publication Data

US 2009/0274487 A1 Nov. 5, 2009

(30) Foreign Application Priority Data

Apr. 30, 2008 (JP) ..... 2008-119038

(51) Int. Cl.
*G03G 15/02* (2006.01)
*G03G 21/18* (2006.01)

(52) U.S. Cl. ..... 399/176; 399/115

(58) Field of Classification Search ..... 399/115, 399/176
See application file for complete search history.

(56) References Cited

U.S. PATENT DOCUMENTS

| | | | | |
|---|---|---|---|---|
| 7,941,077 | B2 * | 5/2011 | Oshima et al. | 399/168 |
| 2007/0116493 | A1 * | 5/2007 | Nakamura et al. | 399/176 |
| 2008/0101819 | A1 | 5/2008 | Nakamura et al. | |

FOREIGN PATENT DOCUMENTS

| | | |
|---|---|---|
| JP | 7-77859 | 3/1995 |
| JP | 3240759 | 10/2001 |
| JP | 2003-277622 | 10/2003 |
| JP | 2005-85601 | 3/2005 |
| JP | 3766616 | 2/2006 |

* cited by examiner

*Primary Examiner* — David Gray
*Assistant Examiner* — Joseph S Wong
(74) *Attorney, Agent, or Firm* — Cooper & Dunham LLP

(57) ABSTRACT

A charging member is provided in which a minute gap between an image support body and the charging member is set widely but even so the charging member does not abnormally discharge easily, the charging member includes a conductive support body 903, an electrical resistance adjustment layer 902 disposed on the conductive support body 903 and a surface layer 901 disposed on the electrical resistance adjustment layer 902 in which the surface layer contains at least (a) polyol resin grafted with fluorine or silicon, (b) polyether polyol resin, (c) organic anion salt that contains fluorine and alkali metal or alkali earth metal and (d) polyisocyanate.

17 Claims, 4 Drawing Sheets

CHARGING MEMBER, CHARGING DEVICE INCLUDING THE CHARGING MEMBER, PROCESS CARTRIDGE INCLUDING THE CHARGING DEVICE AND IMAGE FORMING APPARATUS INCLUDING THE PROCESS CARTRIDGE

PRIORITY CLAIM

This application claims priority from Japanese Patent Application No. 2008-119038, filed with the Japanese Patent Office on Apr. 30, 2008, the contents of which are incorporated herein by reference in their entirety.

BACKGROUND

1. Technical Field

This disclosure relates to a charging member used in an image forming apparatus of a copier, a laser beam printer and a facsimile or the like, also to a charging device including the charging member, a process cartridge including the charging device and an image forming apparatus including the process cartridge.

2. Description of the Related Art

A charging device that performs a charging processing against an image support body (photoconductive drum) is used in a conventional electro-photo type image forming apparatus of an electronic photo copier, a laser printer, a facsimile or the like. FIG. 6 is a schematic diagram of an electro-photo type image forming apparatus having a conventional charge roller.

In FIG. 6, 130 is a conventional electro-photo type image forming apparatus. The conventional electro-photo type image forming apparatus 130 includes a photoconductive drum 111 in which an electrostatic latent image is formed, a charging member (charge roller) 112 that performs the charging processing by contacting the photoconductive drum 111, an exposure device 113 of a laser beam or the like, a toner support body (image development roller) 114 that makes toner 115 to adhere onto the electrostatic latent image of the photoconductive drum 111, a transfer member (transfer roller) 116 that transfers a toner image on the photoconductive drum 111 onto a recording paper 117 and a cleaning member (cleaning blade) 118 for cleaning the photoconductive drum 111 after the transfer processing. In the FIG. 6, 119 are eliminated toners obtained from removing by the cleaning member 118 residual toners on a surface of the photoconductive drum 111, 120 is an image development device and 121 is a cleaning device. In addition, in the FIG. 6, functional units normally necessary at other electro-photo processes are not necessary in the present specification and are thereby abbreviated.

Next, basic image forming operations of the image forming apparatus 130 of the conventional electro-photo type are described.

When DC voltage is fed from a bias supply (not illustrated) against the charging roller 112 which is in contact with the photoconductive drum 111, the surface of the photoconductive drum 111 is charged uniformly to a high electric potential. Soon afterwards, when image light is projected by the exposure device 113 onto the surface of the photoconductive drum 111, an electric potential of a part irradiated by the photoconductive drum 111 decreases. Such a charging mechanism by the charging roller 112 towards the surface of the photoconductive drum 111 is in fact known to be discharges according to the Paschen's Law in an infinitesimal space between the charging roller 112 and the photoconductive drum 111.

Image light is light quantity distributions according to black/white of an image. When such image light is projected, due to irradiations of the image light, an electrical potential distribution corresponding to a recorded image, that is, an electrostatic latent image is formed on a surface of the photoconductive drum 111. In such a way, when the part of the photoconductive drum 111 formed with the electrostatic latent image passes through the image development roller 114, toners become adhered in correspondence to highs or lows of the electrical potential and a toner image visualizing the electrostatic latent image is formed. The recording paper 117 is carried at a predetermined timing by resist rollers (not illustrated) to the part of the photoconductive drum 111 formed with the toner image to double the toner image. Then after the toner image is transferred onto the recording paper by the transfer roller 116, the recording paper 117 becomes separated from the photoconductive drum 111. The separated recording paper 117 is carried through a transport path. The recording paper 117 is then heated and fixed by a fixing unit (not illustrated) to be ejected outside the machine. When transfer is terminated in such a way, the surface of the photoconductive drum 111 is applied cleaning processing by the cleaning member 118. Furthermore, residual electric charges are removed by a quenching lamp (not illustrated) to prepare for the next image forming process.

With regard to a charging member used in such an image forming apparatus, a charging by contact type is widely used in which the charging member contacts the surface of the image support body so that the surface of the image support body is charged. During usage of the charging member, adherent substances such as residual toners on the surface of the image support body, toners deteriorated due to oxidized gas generated by discharges of the charging member and toner constituent substances or the like adhere to the surface of the charging member so that taint generated as such to the charging member becomes problematic. Therefore, in order to remove these adherent substances, the cleaning member is disposed on the surface of the charging member. However, the cleaning member becomes tainted over time by the adherent substances removed from the charging member by the cleaning member so that cleaning capabilities of the cleaning member decreases. Therefore, discharge irregularities are generated by the adherent substances adhered to the charging member and abnormal images generated become problematic.

Thereby a non-charging by contact type charging member is gradually adopted to charge the image support body surface in which the charging member is disposed to be in close contact with the image support body with an constant space (minute gap) maintained between the charging member and the image support body. In the case the charging member of the non-charging by contact type is used, the charging member is not in direct contact with the image support body so that the surface of the charging member becomes difficult to be tainted. Therefore, the charging member of the non-charging by contact type is possible to have a longer life span than the charging member of the charging by contact type. However, in the case the charging member of the non-charging by contact type is used, in order to prevent charge irregularities due to changes of the minute gap, high voltage AC voltage is impressed doubly with DC voltage to the charging member. Therefore, adherents of the image support body flies between the image support body and the charging member so that over time, adherents of the image support body is gradually accumulated on the surface of the charging member. Therefore, finally, irregularities of electrical resistances are generated due to the adherents adhered to the surface of the charging member. Discharge irregularities are generated due to the irregularities of the electrical resistances so that it is problematic that abnormal images are generated.

By the way, if the minute gap between the image support body and the charging member can be widened as much as possible, then the adherence of tainted substances can be reduced. But if the minute gap becomes too wide, voltage of the AC voltage needs to be heightened. Therefore, abnormal discharges due to leakage become easy to be generated so that abnormal images (white spot) are easily generated. Therefore, the minute gap between the image support body and the charging member can not be widened.

In addition, the charging member used for the image forming apparatus is necessarily electrically conductive. In order to realize the electrically conductive charging member, if for example, carbon black of an electrically conductive system is used as a conductive agent, abnormal discharges due to local leaks become easy to be generated when high AC voltage is impressed. Therefore, minute gaps between the image support body and the charging member can not be widened. Therefore, a conductive agent of an ion conductive system is preferable for the conductive agent that makes the charging member electrically conductive. But lower electrical resistance of a coating material is difficult to be realized if a conventional conductive agent of the ion conductive system is used. Therefore, with reference to Laid-open Japanese patent publication No. Hei 7-77859, conventionally, in order to reduce leaks of the charging member, an electrical resistance adjustment layer that constitutes the charging member is formed using an adjustment layer of the ion conductive system whereas a surface layer that constitutes the charging member is formed using a surface layer of the electrically conductive system. However, such constitutions are not sufficient.

BRIEF SUMMARY

In an aspect of this disclosure, there is provided a charging member that is unlikely to abnormally discharge even when a minute gap between an image support body and the charging member is made wider as well as a charging device including the charging member, a process cartridge including the charging device and an image forming apparatus including the process cartridge.

In another aspect, the charging member includes an electrically conductive support body, an electrical resistance adjustment layer disposed on the electrically conductive support body and a surface layer disposed on the electrical resistance adjustment layer. In addition, the surface layer of the charging member contains at least (a) polyol resin grafted with fluorine or silicon, (b) polyether polyol resin, (c) organic anion salt that contains fluorine and alkali metal or alkali earth metal and (d) polyisocyanate.

DETAILED DESCRIPTION OF THE PREFERRED EMBODIMENTS

An embodiment of the present invention is described hereinbelow with reference to the accompanying drawings.

Figure 1:
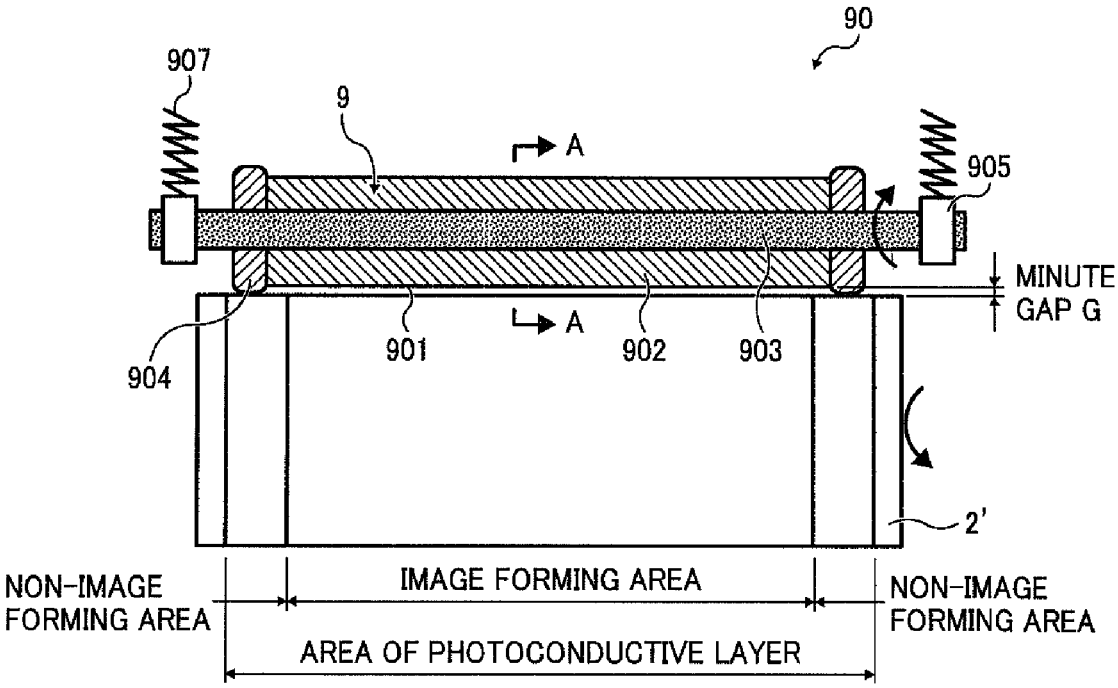
FIG. 1 is a frame format diagram illustrating a state in which the charging member (charging roller) of an embodiment of the present invention is disposed on an image support body.
Figure 2:
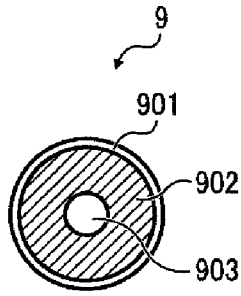
FIG. 2 is a cross sectional diagram along the A-A line of FIG. 1.
Figure 3:
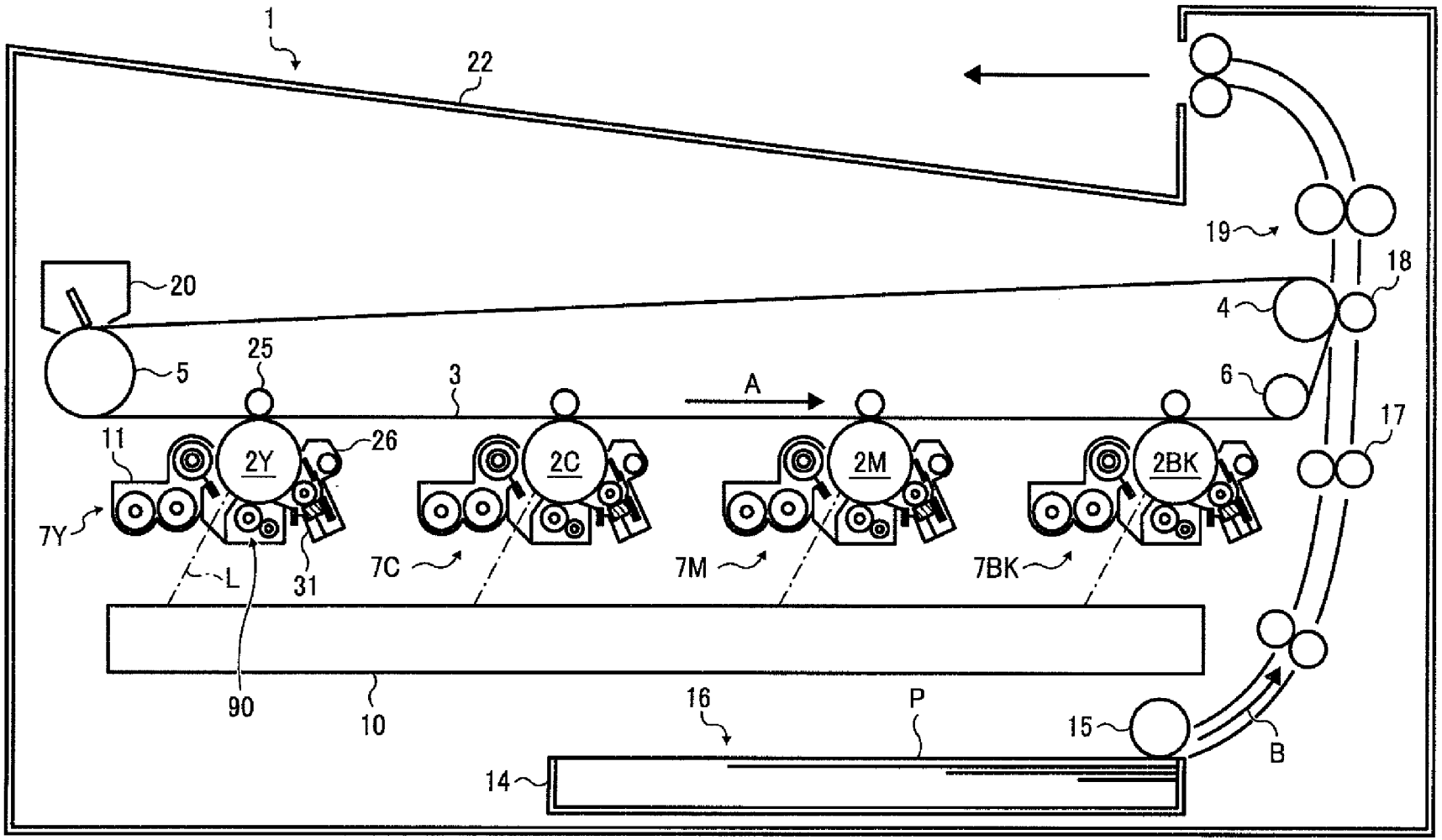
FIG. 3 is a schematic diagram of an image forming apparatus of an embodiment of the present invention.
Figure 4:
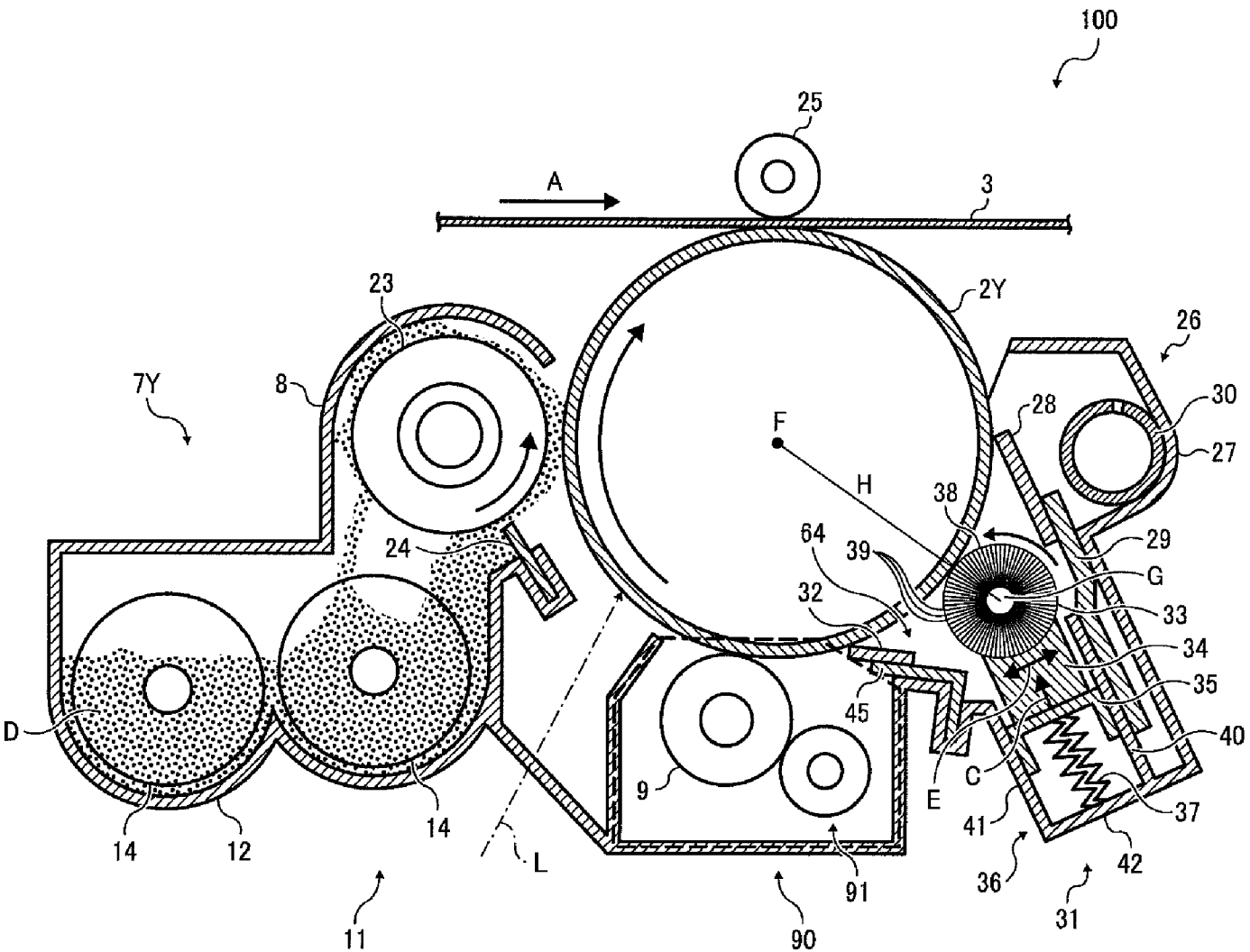
FIG. 4 is a schematic diagram illustrating a constitution of an image forming part in the image forming apparatus of an embodiment of the present invention.
Figure 5:
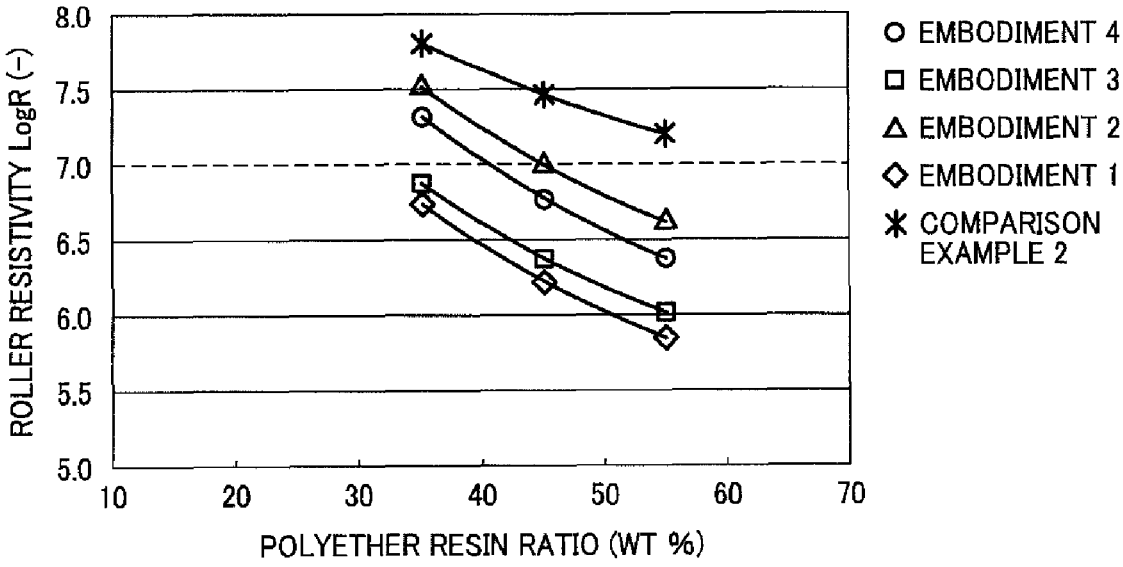
FIG. 5 is a graph obtained from embodiment 1 through 4 and comparison example 1 through 2 illustrating a relationship between a roller electrical resistivity and a polyether resin ratio of the charging roller.
Figure 6:
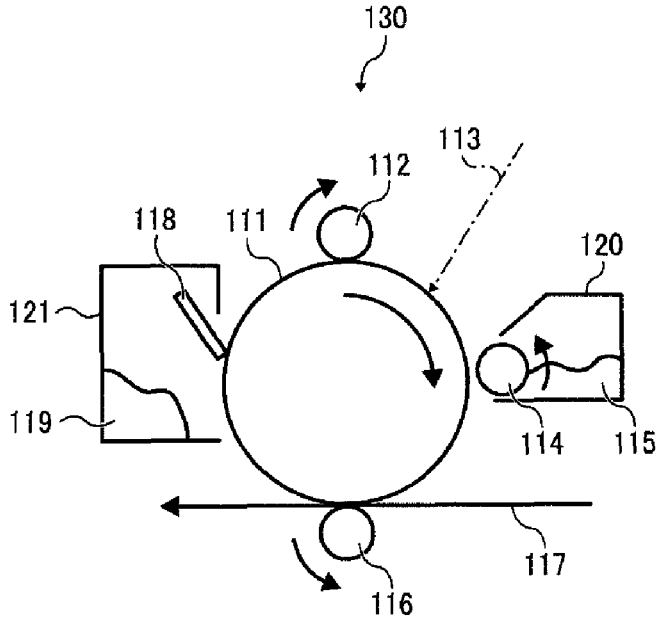
FIG. 6 is a schematic diagram of a conventional image forming apparatus.

FIG. 1 is a frame format diagram illustrating a state in which the charging member (charging roller) of an embodiment of the present invention is disposed on an image support body. FIG. 2 is a cross sectional diagram along the A-A line of FIG. 1. FIG. 3 is a schematic diagram of an image forming apparatus of an embodiment of the present invention. FIG. 4 is a schematic diagram illustrating a constitution of an image forming part in the image forming apparatus of an embodiment of the present invention. FIG. 5 is a graph obtained from embodiment 1 through 4 and comparison example 1 through 2 illustrating a relationship between a roller electrical resistivity and a polyether resin ratio of the charging roller.

In FIG. 1 and FIG. 2, 9 is a charging member. The charging member 9 includes an electrically conductive support body 903, an electrical resistance adjustment layer 902 disposed on the electrically conductive support body 903 and a surface layer 901 disposed on the electrical resistance adjustment layer 902. In addition, the surface layer 901 contains at least (a) polyol resin grafted with fluorine or silicon, (b) polyether polyol resin, (c) organic anion salt that contains fluorine and alkali metal or alkali earth metal and (d) polyisocyanate. In FIG. 1, 90 is a charging device, 904 is a spacing member, 905 is a shaft bearing and 907 is a pressure applying device (compression spring) that pressures the spacing member 904 so that the spacing member 904 comes into contact with an image support body 2Y.

In such a way, the charging member 9 includes the electrically conductive support body 903, the electrical resistance adjustment layer 902 disposed on the electrically conductive support body 903 and the surface layer 901 disposed on the electrical resistance adjustment layer 902. In addition, the surface layer 901 contains at least (a) polyol resin grafted with fluorine or silicon, (b) polyether polyol resin, (c) organic anion salt that contains fluorine and alkali metal or alkali earth metal and (d) polyisocyanate. Therefore, the charging member 9 can realize a low electrical resistance so that even in the case a minute gap G between the image support body 2Y and the charging member 9 is made wider, the charging member 9 that is unlikely to abnormally discharge can be provided.

In the present invention, the polyether polyol resin is preferably contained in a ratio of 30 through 60 wt % against all resins that constitute the surface layer 901. In such a way, if the polyether polyol resin is contained in a ratio of 30 through 60 wt % against all resins that constitute the surface layer 901, the charging member 9 can all the more realize the low electrical resistance property so that even in the case the minute gap G between the image support body 2Y and the charging member 9 is made wider, the charging member 9 that is unlikely to abnormally discharge can be provided.

In addition, in the present invention, a containing quantity of polyether in the polyether polyol resin is preferably 10 through 40 wt % in the form of ethylene oxide. In such a way, if the containing quantity of polyether in the polyether polyol resin is 10 through 40 wt % in the form of ethylene oxide, the charging member 9 can all the more realize the low electrical resistance property so that even in the case the minute gap G between the image support body 2Y and the charging member 9 is made wider, the charging member 9 that is unlikely to abnormally discharge can be provided. In addition, in the case of a resin with a large polyether containing quantity, lowering of a polyether resin ratio among all resins becomes possible so that a coating film strength of the surface layer 901 can be heightened.

The surface layer 901 contains organic acid salts of diazabicyclo undecene or diazabicyclo nonen and is hardened under the presence of catalysts made from the organic acid salts. In such a way, if the surface layer 901 contains organic acid salts of diazabicyclo undecene or diazabicyclo nonen and is hardened under the presence of catalysts made from the organic acid salts, even when a ratio of the polyether is heightened, the hardening reaction becomes heightened. Therefore, the surface layer 901 realizing a low electric resistance property can be obtained easily so that the charging member 9 all the more unlikely to abnormally discharge can be provided.

In the present invention, the spacing member 904 of a ring shape that comes into contact with the image support body 2Y and forms a constant minute gap G is disposed at both end parts of the charging member 9. In such a way, if the spacing member 904 of a ring shape that comes into contact with the image support body 2Y and forms a constant minute gap G is disposed at both end parts of the charging member 9, residual substances of toners or the like remaining on the surface of the image support body 2Y become further difficult to adhere to the charging member 9.

Next, the spacing member 904, the electrical resistance adjustment layer 902 and the surface layer 901 that constitute the charging member (charging roller) 9 are described in detail.

[With Regard to the Spacing Member 904]

A necessary characteristic of the spacing member 904 is to form with stability the minute gap G between the charging member 9 and a photo conductor 2Y over a long time span and an environment. Therefore, a material with small hygroscopic properties and wear withstanding properties is desired. In addition, it is also important that toners and a toner addition agent become difficult to adhere to the spacing member 904. Besides, because the spacing member 904 comes into sliding contact with the photo conductor 2Y, it is also important that the photo conductor 2Y does not wear. Consequently, the material for the spacing member 904 should be appropriately selected according to various conditions. The material constituting the spacing member 904 can specifically be, for example, general purpose resins of polyethylene (PE), polypropylene (PP), polyacetal (POM), polymethylmethacrylate (PMMA), polystyrene (PS) and copolymers (AS, ABS) of these as well as polycarbonate (PC), urethane, fluorine (PTFE) or the like. In particular, in order to fix the spacing member 904 certainly, an adhesive agent can be applied for adhesion. In addition, an insulating material is preferable for the spacing member 904. Specifically, an insulating material with a volume resistivity greater than or equal to $10^{-13}$ Ωcm is preferable. Insulation properties are necessary because generations of leakage currents with the photo conductor 2Y need to be eliminated. The spacing member 904 is formed by a molding process.

A part of the spacing member 904 has differences in height with the electrical resistance adjustment layer 902. As a method to form the minute gap G, the electrical resistance adjustment layer 902 and the spacing member 904 can be simultaneously worked by a removal processing of cutting and grinding or the like. If the electrical resistance adjustment layer 902 and the spacing member 904 are simultaneously worked, then the minute gap G can possibly be formed in high precision. A height of a part of the spacing member 904 adjacent to the electrical resistance adjustment layer 902 can be the same to a height of the electrical resistance adjustment layer 902 or made lower than the height of the electrical resistance adjustment layer 902. As a result, a contact width between the spacing member 904 and the photo conductor 2Y is reduced so that the minute gap G between the charging member 9 and the photo conductor 2Y can have a high precision. In such a way, an external surface of a side end part of the spacing member 904 of the electrical resistance adjustment layer 902 side can avoid coming into contact with the image support body 2Y. Therefore, possible prevention is made to leak currents generated if the electrical resistance adjustment layer 902 adjacent via the side end part contacts the image support body 2Y. In addition, by applying work that lowers the end part of the spacing member 904 of the electrical resistance adjustment layer 902 side, the end part can be set as a clearance (clearance processing) of a cutting blade or the like when performing the removal processing. In addition, a shape of the clearance (clearance processing) can be any shape as long as the shape is such that the external surface of the end part of the spacing member 904 does not come into contact with the image support body 2Y. Furthermore, when the surface layer 901 is applied coating, control difficulties arise in consideration to a variability if a masking is performed at a boundary between the electrical resistance adjustment layer 902 and the spacing member 904. Therefore, when a level difference is formed, the surface layer 901 should be formed until the surface layer reaches the spacing member 904. The spacing member 904 is formed to be lower than or with a same height with the electrical resistance adjustment layer 902. Thereby the surface layer 901 can be formed certainly on the electrical resistance adjustment layer 902.

[With Regard to the Electrical Resistance Adjustment Layer 902]

The electrical resistance adjustment layer 902 is formed by a thermal plastic resin composition in which an ion conductive material of a high-molecular form is dispersed. A volume resistivity of the electrical resistance adjustment layer 902 is preferably $10^{-6}$ through $10^{-9}$ Ωcm. If the volume resistivity of the electrical resistance adjustment layer 902 exceeds $10^{-9}$ Ωcm, charging capabilities and transfer capabilities become insufficient. In addition, if the volume resistivity of the electrical resistance adjustment layer 902 is lower than $10^{-6}$ Ωcm, leaks are generated due to current concentrations to the entire photo conductor 2Y. The electrical resistance adjustment layer 902 is preferably constituted from polypropylene (PP), polymethylmethacrylate (PMMA), polystyrene (PS) and copolymers (AS, ABS) of these as well as thermal plastic resins of polyamide and polycarbonate (PC) or the like. The ion conductive material of the high-molecular form that enables dispersion of these thermal plastic resins is preferably a high polymer compound containing polyether ester amide component. The polyether ester amide is a high-molecular material having an ion conductive property. The polyether ester amide is dispersed and immobilized uniformly at molecular level inside a matrix polymer. A variability of a resistance value accompanying poor dispersion is well seen in a composition dispersed with an electrically conductive agent of an electrically conductive system, that is, carbon black or the like. However, such a variability of a resistance value is not generated in this case. In addition, when the charging member (charging roller) 9 applies a high impressing pressure, in the case of the electrically conductive agent of the electrically conductive system, a path through which an electricity is more likely to flow is formed locally so that leak currents towards the image support body 2Y are generated and abnormal images, that is, black and white spotty images are generated in the case of the charging member 9. In contrast, because polyether ester amide is a high-molecular material so that a bleed out is hardly generated. With regard to a blending quantity, because the resistance value needs to be set to a desired value, the thermal plastic resin needs to be 20 through 70 wt % and the ion conductive material of the high-molecular form needs to be 80 through 20 wt %.

Furthermore, in order to adjust the resistance value, electrolyte (salt) can be possibly added. The salt can be alkali metal salt of sodium perchlorate and lithium perchlorate or the like, lithium imide salt of lithium bis imide and lithium tris methide or the like as well as quaternary phosphonium salt of ethyl-tri-phenyl-phosphonium tetrafluoroborate and tetra-phenyl-phosphonium bromide or the like. The electrically conductive agent can be used singly or blended multiply within a range not damaging physical properties. In order for the conductive material to disperse uniformly at the molecular level inside the matrix polymer, a compatibilizer can be properly used because micro dispersion in the charging material becomes possible if the compatibilizer is added. The compatibilizer can be a compatibilizer having a glycidyl methacrylate group which is a reactive group. Other addition agents of antioxidizing agent or the like can be used within a range not damaging physical properties. A manufacturing method of the resin composition is not particularly limited but easy manufacture is realized by mixing each material for melting and mixing in a two shaft mixer machine and a kneader or the like. In addition, formation of the electrical resistance adjustment layer 902 on the electrically conductive support body (core bar) 903 can be realized easily if the electrically conductive support body 903 is covered by the resin composition using press molding and injection molding or the like.

When the charging member 9 adopts a constitution in which only the electrical resistance adjustment layer 902 is formed on the electrically conductive support body 903, there are cases in which toners and addition agents of the toners or the like are fixated to the electrical resistance adjustment layer 902 so that performance decrement occurs. Such defects can be prevented by forming the surface layer 901 onto the electrical resistance adjustment layer 902. In addition, in the case a contact technique is employed, the charging member 9 needs to be an elastic body. In that case, an elastic electrical resistance adjustment layer 902 can be formed by adding various kinds of conductive agents to rubber materials of silicone, NBR, epichlorohydrin and EPDM or the like. Conventionally used methods can be used for processing methods of the rubber materials.

[With Regard to the Surface Layer 901]

As a material that forms the surface layer 901, resins of fluorine series resins, silicone series resins, polyamide resin and polyester resin or the like are excellent in non-adhesive properties so that these resins are preferable from an aspect of preventing toner fixation. In addition, formation of the surface layer 901 onto the electrical resistance adjustment layer 902 are performed by coating a coating material onto the electrical resistance adjustment layer 902 by various coating methods of spray coating, dipping and roll coating or the like. The coating material is adjusted by dissolving the resins that constitute the surface layer 901 into organic solvents. Film thickness of the surface layer 901 is preferably 10 through 50 μm.

A coating material of either a liquid coating material 1 or a liquid coating material 2 can be used for a material that constitutes the surface layer 901. The liquid coating material 2 combines a hardening agent so that if the liquid coating material 2 is used, an environment withstanding property, a non-adhesive property and a mold releasing property can be heightened. In the case of the liquid coating material 2, a general method is adopted in which a coating film is heated to cross link and harden the resin. However, because the electrical resistance adjustment layer 902 is constituted from thermal plastic resin, heating at a high temperature is not possible. Therefore, it is effective to use a base resin having a hydroxyl group within a molecule and isocyanate series resins that develops a cross linking reaction with the hydroxyl group. The isocyanate series resins can be a polyisocyanate resin and specifically, 2,4-trilene diisocyanate, diphenylmethane-4,4'-diisocyanate, xylylene diisocyanate, isophorone diisocyanate, lysine-methyl-ester diisocyanate, methylcyclohexyl-diisocyanate, trimethyl-hexamethylene diisocyanate, hexamethylene diisocyanate, n-pentane-1,4-diisocyanate as well as trimer of these, adduct bodies and burette bodies of these, copolymers of these having two or more isocyanate groups and furthermore, a blocked isocyanate class or the like. But the isocyanate series resins are not limited to these. By using isocyanate series resins, cross linking and hardening reactions occur at a comparatively low temperature below 100° C. A blending quantity of the hardening agent is 0.1 through 5 weight per equivalent against 1 weight per equivalent of the functional group (—OH group) and preferably 0.5 through 1.5 weight per equivalent. In addition, a hardening agent of amino resins, that is, melamine and guanamine resin or the like can be properly used in correspondence to heat withstanding properties of the base material. From the non-adhesive property of the toners, resins grafted with silicon or fluorine within a molecule is easily workable as resins for the surface layer.

In order for an agent that provide electrically conductive properties (electrolyte salt) to be ion conductive, the agent can be alkaline metal salt of perchloric acid, that is, sodium perchlorate and lithium perchlorate or the like, alkaline earth metal salt, fluorine organic anion salt of lithium-bis (trifluoro methanesulfonyl) imide, lithium-tris (trifluoro methanesulfonyl) methane, trifluoro methane sulfo acid lithium, lithium tris methide, ethyl tri phenyl phosphonium-tetra fluoro borate, tetra phenyl phosphonium bromide or the like as well as organic ion conductive materials of modified aliphatic acid dimethyl ammonium ethosulphate, stearic acid ammonium acetate and lauryl ammonium acetate or the like. The present inventors found out the coating film (the surface layer) can have low electrical resistance property if among the above materials for the agent, lithium bis (tri-fluoro-methane-sulfonyl) imide, lithium tris (trifluoro methanesulfonyl) methane and trifluoro methane sulfone acid lithium are used.

In addition, in order to realize low electrical resistance by a demonstration of ion conductive properties, polyether polyol class constituted from polyethylene oxide, polypropylene oxide, copolymer of polyethylene oxide-polypropylene oxide and copolymer of polyethylene-polyethylene glycol graft needs to be added. A containing quantity of these polyether polyol resins is preferably 20 through 70 wt % against all resins that form the surface layer (coating film) and further preferably 30 through 60 wt %. In addition, a quantity of polyether within polyether polyol is preferably 5 through 55 wt % and further preferably 10 through wt % in the form of ethylene oxide.

In addition, an addition quantity of electrolyte salt is preferably 1 through 15 wt % against all resins that form the coating film (surface layer) and further preferably, 1.5 through 10 wt %. A conductive agent can be used singly or blended multiply within a range not damaging physical properties.

In the present invention, the charging apparatus 90 includes a charging member 9 described in the present invention. The charging apparatus 90 as such including the charging member 9 described in the present invention can realize the low electrical resistance of the charging member 9 so that the charging device 90 that is unlikely to abnormally discharge even when the minute gap G between an image support body 2Y and the charging member 9 is made wider can be provided.

Next, the charging apparatus 90 of the present invention is described in detail.

The charging apparatus 90 of the present invention is a part encircled by a dotted line of FIG. 4. A solid lubricant agent decomposes by discharges to obtain decomposition products. A cleaning member 91 for removing the decomposition products or toners attached onto the surface of the charging member 9 is disposed on the charging device 90. In the charging device 90, the cleaning member 91 is constituted from melamine foam. The melamine foam is foam of consecutive bubbles. The cleaning member 91 comes into contact with the surface of the charging member 9 and is rotated integrally with the charging member 9. The cleaning member 91 can be directly driven via a gear or the like. But it is preferable from a cleaning viewpoint that the cleaning member 91 has equal speed with the charging member 9.

The charging device 90 includes a power source (not illustrated) that impresses voltage to the charging member 9. For the voltage, a case with only DC voltage is fine but DC voltage and AC voltage are preferably doubled. In particular, in the case of the non-contact type, charge irregularities become easily generated due to changes of the minute gap G between the image support body (photoconductor) 2Y and the charging member (charging roller) 9 so that when only DC voltage is applied, there are cases in which surface electrical potentials of the image support body 2Y become non-uniform. A voltage in which DC voltage and AC voltage are doubled, the surface of the charging roller 9 possesses equal electrical potential so that discharges become stable and the image support body 2Y can be charged uniformly. In the AC voltage of the doubled voltage, voltage between peaks is preferably two times or more of a voltage at the start of charging of the image support body 2Y. The voltage at the start of charging is an absolute value of a voltage of when the image support body 2Y begins to be charged in the case only direct current is impressed to the charging roller 9. In such a way, reverse discharges from the image support body 2Y to the charging roller 9 are generated and by an even out effect thereof, the image support body 2Y can be charged uniformly in a more stable state. In addition, a frequency of the AC voltage is desirably 7 times or more of a circumferential velocity (process speed) of the image support body 2Y. By setting the frequency to be 7 times or more, moiré images is no longer recognizable by the eye.

The charging device 90 of the present invention includes a cylindrical shaped charging member 9 disposed opposed to the photoconductive drum 2Y and a cylindrical shaped charged cleaning member 91 disposed to come into contact with a surface situated at a reverse side to a surface in which the charging member opposes the photoconductive drum 2Y. In addition, both end parts of the charging member 9 are respectively urged towards the side of the photoconductive drum 2Y by the compression spring 907 which is the pressure applying device. The charging member 9 is connected to a not illustrated power source and impressed with a predetermined voltage. With regard to the voltage, it is fine when only the DC voltage is used but preferably, DC voltage should be doubled with AC voltage. By impressing the AC voltage, the surface of the photoconductive drum 2Y can be charged more uniformly. The charging member 9 can be disposed to be in contact with the photoconductive drum 2Y. But in the present embodiment, the charging member 9 is disposed with a minute gap G against the photoconductive drum 2Y. The minute gap G can be set by providing a spacing member 904 having a certain thickness in a non-image forming area of the both end parts of the charging member 9 so that a surface of the spacing member 904 comes into contact with a surface of the photoconductive drum 2Y.

The minute gap G between the charging member 9 and the photoconductive drum 2Y is limited to below 100 μm and preferably, in a range of about 5 through 70 μm in a distance thereof. In such a way, formation of abnormal images during operation of the charging device 90 can be suppressed. If the minute gap G is above 100 μm, the distance reaching the photoconductive drum 2Y becomes longer so that a voltage according to the Paschen's Law at the start of discharge becomes larger and furthermore, the space of the discharge until the photoconductive drum 2Y becomes large. Therefore, in order for the photoconductive drum 2Y to be applied with a predetermined charge, a great amount of discharge products generated by discharges becomes necessary. The discharge products remains in a great amount in the space of discharge even after image formation and becomes adhered to the photoconductive drum 2Y which instead becomes a reason that foster deteriorations over time of the photoconductive drum 2Y. In addition, if the minute space G is small, the distance reaching the photoconductive drum 2Y becomes shorter so that the photoconductive drum 2Y can be charged even with a small discharge energy. However, the minute gap G formed by the charging member 9 and the photoconductive drum 2Y becomes narrower and air flow becomes worse. Therefore, because the discharge products formed in the space of discharge remains within the space, in the same way to the case in which the minute gap G is large, the discharge products remains in a large amount in the space of discharge even after image formation and adhere to the photoconductive drum 2Y. The discharge products become a reason that foster deteriorations over time of the photoconductive drum 2Y. Consequently, discharge energies should be made smaller and little discharge products should be generated. A space should be preferably formed to an extent in which air does not remain. Accordingly, the minute gap G is limited to below 100 μm and preferably, in a range of about 5 through 70 μm. Hence generations of streamer discharges can be prevented and little discharge products are generated. As a result, an amount accumulated on the photoconductive drum 2Y is lessened so that spot shaped spotty image and image flows can be prevented.

Hereby residual toners on the photoconductive drum 2Y after image development is cleaned by a cleaning device 64 disposed opposed to the photoconductive drum 2Y. But complete removal is difficult. Therefore, toners to a negligible extent pass through the cleaning device 64 and are carried over to the charging device 90. At this moment, if a particle diameter of the toners is larger than the minute gap G, the toners is in slide abrasion with the photoconductive drum 2Y and the charging member 9 to take on heat. The toners are then possibly fusion bonded to the charging member 9. Abnormal discharges occur in a part fusion bonded with the toners because the part is situated closer to the photoconductive drum 2Y and discharges are generated preferentially. Consequently, the minute gap G is preferably larger than a maximum diameter of the toners used for an image forming apparatus 1.

In addition, the charging member 9 is fitted into a shaft bearing 905 disposed on a side plate of a not illustrated housing. The shaft bearing 905 is not driven and is constituted from a resin with a low friction coefficient. The compression spring 907 is disposed on the shaft bearing. The charging member 9 is pressed by the compression spring 907 towards a surface direction of the photoconductor drum. In such a way, a constant minute gap G can be formed even with mechanical oscillations and deflections of the core bar. The pressed load is preferably 4 through 25 N and further preferably 6 through 15 N. Even so that the charging member 9 is fixed by the shaft bearing 905, due to concave and convexities of the surface of the charging member as well as oscillations during operations, the size of the minute gap G fluctuates. Therefore, there are cases in which the minute gap G deviates from the appropriate range which fosters the deteriorations of the photoconductive drum 2Y over time. Hereby the load means all loads applied to the photoconductive drum 2Y through the spacing member 904. The load can be adjusted by a force of the compression spring 907 disposed at the both ends of the charging member 9 and by own weights of the charging member 9 and the cleaning member 91 or the like. Fluctuations are generated due to rotating of the charging member 9 and jump ups are generated by cause of an impact strength of a drive gear or the like. If the load is too small, both the fluctuations of the minute gap G and the jump ups can not be suppressed. If the load is too large, frictions between the charging member 9 and the shaft bearing 905 to which the charging member 9 is fitted into become large so that over time, a quantity of wear becomes large and fluctuations of the minute gap G are fostered. Consequently, the load should preferably be in the range of 4 through 25 N and further preferably 6 through 15 N. In such a way, the minute gap G can be set to an appropriate range and the generation of the discharged products can be lessened so that the quantity of adherents accumulated on the photoconductor drum 2Y can be lessened and operating life of the photoconductor drum 2Y can be extended. In addition, spot shaped spotty images and image flows can be prevented.

The charging member 9 is cylindrically shaped. A pair of gears is disposed in both end parts of the charging member 9. The charging member 9 is rotatably supported via these gears. Alternatively, the both ends of the charging member 9 are rotatably supported by the shaft bearing 905. As described above, the charging member 9 is cylindrically shaped. Therefore, a surface of the charging member 9 is actually a curved surface that becomes gradually further away from a nearest adjacent part of the image support body 2Y. Consequently, the image support body 2Y can be further uniformly charged. If a part of the charging member 9 facing the image support body 2Y is sharp pointed, an electrical field in the vicinity of the part becomes strong and discharges begin from there so that non-uniform discharges are generated. As a result, it becomes difficult to uniformly charge the surface of the image support body 2Y. Therefore, because the charging member 9 is cylindrical shaped, the image support body 2Y can be charged uniformly. In addition, generally, a surface part of the charging member 9 in which discharges are generated has increased deterioration speed in comparison to other parts in which discharges are not generated. If there is a sharp pointed part to the charging member 9, discharges are always generated at the part, deteriorations at the part is further progressed. If the discharge at the part further continues, the part can be scraped off. Therefore, by rotating the charging member 9, an entire side surface of the charging member can be used as the discharge surface. As a result, early deteriorations of the charging member 9 can be prevented and the charging member 9 can be used over a long time span.

As illustrated in FIG. 3 and FIG. 4, in a process cartridge 7Y of the present invention, the image support body 2Y and the charging device 90 are supported integrally and fixed to a main body of an image forming apparatus 100 to be freely detachable. Then in the process cartridge as such, the charging device 90 is constituted from the charging device described in the present invention. In such a way, the image support body 2Y and the charging device 90 are supported integrally and the process cartridge 7Y is fixed to the main body of the image forming apparatus 100 to be freely detachable. In addition, the charging device 90 is constituted from the charging device described in the present invention. Therefore, stable images can be obtained over a long period and replacement is simplified because user maintenance is possible.

In addition, as illustrated in FIG. 3, the image forming apparatus 1 of the present invention includes at least a process cartridge 7Y, an exposure device that forms an electrostatic latent image by performing an exposure on the surface of the image support body 2Y, an image development device 11 that visualizes the electrostatic latent image on the surface of the image support body 2Y by supplying toners, a transfer device (transfer roller 25) that transfers onto a transfer media (intermediate transfer belt 3) a visualized image on the surface of the image support body 2Y. In addition, in the image forming apparatus 1 of the present invention, the process cartridge is constituted from a process cartridge described in claim 7. In such a way, if the process cartridge 7Y is constituted from the process cartridge described in claim 7, high image quality can be obtained and stable images can be obtained over a long time span.

Next, the image forming apparatus 1 is described in detail. As illustrated in FIG. 3 and FIG. 4, the image forming apparatus 1 of the present invention includes an intermediate transfer belt 3 with no end rotated and driven in a direction of an arrow A and wrapped around a plurality of supporting rollers 4, 5 and 6. The image forming apparatus 1 also includes a first through a fourth process cartridges 7Y, 7C, 7M and 7BK disposed to oppose the intermediate transfer belt 3. Each process cartridge 7Y through 7BK includes image support bodies 2Y, 2C, 2M and 2BK constituted as drum shaped photoconductors in which toner images of differing colors are formed respectively. Toner images of differing colors are respectively formed on each image support body. Each toner image is superimposed and transferred on the intermediate transfer belt 3. The intermediate transfer belt 3 constitutes an example of a transfer material to which toner images formed on the image support bodies 2Y, 2C, 2M and 2BK are transferred. A constitution of forming toner images on each image support body 2Y through 2BK of the first through the fourth process cartridges 7Y through 7BK and transferring the toner images onto the intermediate transfer belt 3 is substantially the same only except that colors of the toner images differ so that only the constitution of forming a toner image on the image support body 2Y of the first process cartridge 7Y and transferring the toner image onto the intermediate transfer belt 3 is described.

FIG. 4 is an enlarged cross sectional diagram of the first process cartridge 7Y. The image support body 2Y of the process cartridge 7Y illustrated hereby is supported by a unit case 8 to be freely rotatable and is rotatably driven in a clockwise direction by a not illustrated driving device. At this moment, charging voltages are impressed to a charging roller 9. The charging roller 9 is supported by the unit case 8 to be freely rotatable. In such a way, a surface of the image support body 2Y is charged with a predetermined polarity. A light deflected laser beam L emitted from a light writing device 10 illustrated in FIG. 3 separate from the process cartridge 7Y is irradiated onto the charged image support body. In such a way, an electrostatic latent image is formed on the image support body 2Y. This electrostatic latent image is visualized by an image development device 11 as a yellow toner image.

The image development device 11 includes an image development case 12 constituted by a part of the unit case 8. A binary system dry type developer agent D having a toner and a carrier is held in the image development case 12. In addition, two screws 14 and 14 that stir the developer agent D is disposed in the image development case 12. In addition, an image development roller 23 rotated and driven in a counter clock-wise direction within the FIG. 4 is also disposed in the image development case 12. The image developer agent drawn up to a circumference surface of the image development roller is supported by the circumference surface of the image development roller 23 and carried over in a rotating direction of the image development roller 23. The developer agent having passed through a doctor blade 24 is carried over to an image development area between the image development roller 23 and the image support body 2Y. At this moment, toners within the developer agent are transited in an electrostatic manner onto the electrostatic latent image formed on the image support body 2Y. The latent image is visualized as a toner image. The developer agent having passed through the image development area is separated from the image development roller 23 and stirred by the screws 14 and 14. In such a way, the toner image is formed on the image support body 2Y. In addition, an image development device using a developer agent of a one component system without a carrier can also be adopted.

On the other hand, with the intermediate transfer belt 3 situated inbetween, transfer roller 25 of a first order transfer is disposed at a side opposite to the process cartridge 7Y. When a transfer voltage is impressed to transfer roller 25 of the first order transfer, a toner image on the image support body 2Y is transferred by a first order transfer onto the intermediate transfer belt 3 rotated and driven in the direction of the arrow A. After toner image transfer, residual toners of the transfer adhering to the image support body 2Y is removed by a cleaning device 26. The cleaning device 26 of the present example includes a cleaning case 27 constituted from a part of the unit case 8, a cleaning blade 28 with its tip edge part pressure welded to the image support body 2Y, a blade holder 29 that holds the cleaning blade and a screw 30 for carrying toners disposed within the cleaning case 27. The cleaning blade 28 is disposed in a direction counter to a moving direction of the surface of the image support body 2Y. The cleaning blade 28 is constituted from elastic bodies of rubber or the like. A base end side of the cleaning blade 28 is fixed to the blade holder for example by an adhesive agent. Because the tip edge part of the cleaning blade 28 is pressure welded to the surface of the image support body 2Y in such a way, transfer residual toners on the image support body 2Y can be removed by a scrape off method. The removed toner is carried outward of the cleaning case by a screw 30. The screw 30 is rotated and driven to carry toners. In such a way, the cleaning blade 28 functions to clean the image support body 2Y after the toner image is transferred onto a transfer material, that is, the intermediate transfer belt 3 in the example of FIG. 2.

In addition, the process cartridge 7Y includes a lubricant agent application device 31 that applies a lubricant agent to the image support body 2Y and a blade 32 that functions to even out the lubricant agent applied to the image support body 2Y. However, these are described in detail later.

In the same way to the above described image support body 2Y, a Cyan toner image, a Magenta toner image and a Black toner image are respectively formed on the second through the fourth image support bodies 2C, 2M and 2BK illustrated in FIG. 3. These toner images are sequentially superimposed on the intermediate transfer belt 3 to be transferred by the first order transfer. The intermediate transfer belt 3 is already transferred with a Yellow toner image so that a combining toner image is formed on the intermediate transfer belt 3. The fact that after the toner image transfer, transfer residual toners on each image support body 2C, 2M and 2BK is removed by the cleaning device is no different from the case of the first image support body 2Y.

On the other hand, as illustrated in FIG. 3, a paper feeding cassette 14 holding a recording media P and a paper feeding device 16 having a paper feeding roller 15 are disposed at a lower part within a main body of the image forming apparatus 1 in which the recording media P is for example constituted from transfer paper. An uppermost recording media P is fed out in a direction of an arrow B by rotations of the paper feeding roller 15. The fed out recording media is fed by a pair of resist rollers 17 into a gap between a part of the intermediate transfer belt 3 and a transfer roller 18 of a second order transfer disposed opposite to the part. The intermediate transfer belt 3 is wrapped around a supporting roller 4 at a predetermined timing. At this moment, a predetermined transfer voltage is impressed to the transfer roller 18 of the second order transfer so that a combining toner image on the intermediate transfer belt 3 is transferred by the second order transfer onto the recording media P. The recording media P transferred with the combining toner image by the second order transfer is carried further upwardly to pass through a fixing device 19. At this moment, the toner image on the recording media P is fixed by influences of heat and pressure. The recording media P having passed through the fixing device 19 is discharged to a paper discharge part 22 situated at an upper part of the image forming apparatus 1. In addition, after toner image transfer, residual toners of the transfer adhering onto the intermediate transfer belt 3 is removed by a cleaning device 26.

In order to suppress wears of the cleaning blade 28 and the image support body 2Y illustrated in FIG. 4 and to maintain a high cleaning performance by the cleaning blade 28 even when spherical toners of a small particle diameter are used, the above described lubricant agent application device 31 is disposed in the image forming apparatus of the present example. The lubricant agent application device 31 as such is also disposed in the second through the fourth process cartridges 7C, 7M and 7BK. However, because their constitutions and operations are the same, hereby only the lubricant agent application device 31 of the process cartridge 7Y illustrated in FIG. 4 is described.

The lubricant agent application device 31 illustrated in FIG. 4 includes a brush roller 33 that comes into contact with the surface of the image support body 2Y, a solid lubricant agent disposed opposite to the brush roller 33, a lubricant agent holder 35 that fixedly supports the solid lubricant agent, a guide 36 that guides the solid lubricant agent 34 via the lubricant agent holder 35 and a compression coil spring 37 which is an example of a pressurizing device. The brush roller 33 includes a core shaft 38 and a great amount of brush fibers 39 with their base end parts fixed to the core shaft 38. The brush roller 33 as such is approximately parallel to the image support body 2Y and is long extended along the image support body 2Y. Each end part of a longitudinal direction of the core shaft 38 of the brush roller 33 is supported via not illustrated shaft bearings to be freely rotatable against the unit case 8. During image forming operations, the brush roller 33 is rotated and driven in a counter clock-wise direction in the FIG. 3. In addition, the solid lubricant agent 34 is formed to be parallel to the brush roller 33 with a long extended rectangular shape. A tip end surface of the solid lubricant agent 34 at a side facing the brush roller 33 comes into contact with the brush fibers 39 of the brush roller 33. A surface at a base end side of the solid lubricant agent 34 opposite to the above described tip end surface is fixed to a lubricant agent holder 35. The guide 36 of the present example includes a pair of guide plates 40 and 41 disposed parallel and opposite to each other with an interval. These guide plates 40 and 41 is integrated by a connecting plate 42. The pair of guide plates 40 and 41 as well as the connecting plate 42 are constituted by a part of the unit case 8. The lubricant agent holder 35 is disposed between the pair of guide plates 40 and 41. The lubricant agent holder 35 comes into contact with the pair of mutually facing surfaces of guide plates 40 and 41 to slide along thereof. A method of pressurizing the lubricant agent to the brush roller can be achieved by a spring or the like in which the spring pressurizes the solid lubricant agent 34 against the brush roller 33 via the lubricant agent holder 35. In the FIG. 3, this pressurizing direction is illustrated by an arrow C. In addition, instead of the compression coil spring, a pressurizing device constituted from a torsional coil spring or a board spring or the like can be used.

As described above, the sold lubricant agent 34 is pressure-welded to the brush fibers 39 of the brush roller 33. Besides, the brush fibers 39 are pressure-welded to the surface of the image support body 2Y. At the moment, because the brush roller 33 rotates, lubricant agent of the solid lubricant agent 34 is shaved off by the brush fibers 39 so that the powder shaped shaved off lubricant agent is applied to the surface of the image support body 2Y. As just described, the brush roller 33 constitutes an example of a lubricant agent supply member that supplies to the surface of the image support body the powder shaped lubricant agent shaved off from the solid lubricant agent 34. The solid lubricant agent 34 is shaved off by the brush roller 33 to be consumed. Therefore, a thickness of the solid lubricant agent decreases over time but since the solid lubricant agent is pressurized by the compression coil spring 37, the solid lubricant agent 34 always comes into contact with the brush fibers 39 of the brush roller 33 nevertheless.

Because the lubricant agent is applied to the surface of the image support body 2Y, frictional coefficient of the image support body surface can be suppressed to a low. For this reason, wears of the image support body 2Y and the cleaning blade 28 can be suppressed and their operating lives can be extended. In addition, even when spherical toners of a small particle diameter is used, large decreases in a cleaning performance of the image support body 2Y due to the cleaning blade 28 can be prevented. In addition, the guide 36 is disposed in the lubricant agent application device 31. The lubricant agent holder 35 and the solid lubricant agent 34 are guided by the guide 36 so that substantially, the lubricant agent holder 35 and the solid lubricant agent 34 become only movable in directions that come close or distance away against the brush roller 33. That is, the lubricant agent holder 35 and the solid lubricant agent 34 become only movable in a pressurizing direction C by the compression coil spring 37 and a reverse direction to the pressurizing direction C. Therefore, the solid lubricant agent 34 does not oscillate greatly in a direction E orthogonal to the pressurizing direction C. Consequently, the solid lubricant agent 34 can come into contact with the brush roller 33 with a contact area that is always approximately the same so that the lubricant agent of always approximately the same quantity is supplied to the image support body surface via the brush roller 33. As a result, application irregularities of the lubricant agent to the image support body surface can be prevented.

In the image forming apparatus 1, as illustrated in FIG. 4, a constitution is adopted in which the lubricant agent holder 35 comes into contact with the pair of guide plates 40 and 41 and the solid lubricant agent 34 is guided by the guide 36 via the lubricant agent holder 35. However, another constitution can be adopted in which the solid lubricant agent 34 is guided directly by the guide 36. In addition, the solid lubricant agent 34 is guided by the guide 36 so that the solid lubricant agent 34 is substantially movable only in the direction C to come close or distance away against the brush roller 33. This fact indicates that the solid lubricant agent 34 can move freely for a certain allowance in the direction E orthogonal to the direction C.

As described above, the lubricant agent application device 31 includes a lubricant agent supply member constituted from a brush roller 33. The brush roller 33 rotates and comes into contact with the image support body 2Y. The lubricant agent application device 31 also includes a solid lubricant agent 34 disposed opposite to the lubricant agent supply member and a guide 36 that guides the solid lubricant agent so that substantially, the solid lubricant agent 34 is only movable in directions that come close or distance away against the lubricant agent supply member. The lubricant agent application device 31 also includes a pressurizing device that pressurizes the solid lubricant agent 34 against the lubricant agent supply member. In addition, the image forming apparatus illustrated in FIG. 4 includes a lubricant agent even out device constituted from an even out blade 32. The even out blade 32 is constituted from an elastic body of rubber or the like. A tip edge part of the even out blade comes into contact with the surface of the image support body 2Y. A base end side of the even out blade is fixed to a holder 45. The even out blade 32 is disposed in a trailing direction against a movement direction of the image support body surface. On the other hand, the lubricant agent supply member constituted from the above described brush roller 33, as clear from FIG. 4, is disposed at a more downstream side of the movement direction of the image support body surface than the cleaning blade 28.

According to the above described image forming apparatus 1, after toner image transfer, transfer residual toners adhering to the image support body surface is removed by the cleaning blade 28. The surface of the image support body 2Y turned into a cleaned state in such a way is applied with the lubricant agent by the brush roller 33. Next, when the applied lubricant agent passes through the even out blade 32 which is in contact with the image support body surface, the applied lubricant agent is uniformly pushed and spread onto the surface of the image support body 2Y to be evened out uniformly. In such a way, a lubricant agent layer with a uniform thickness is formed on the image support body. As just described, the lubricant agent is applied just after the image support body 2Y is cleaned and the lubricant agent is evened out. Therefore, non-equitable quantities of lubricant agent application to the image support body surface and non-equitable frictional coefficients of the image support body surface can be prevented for occurrence. Consequently, qualities of images formed on the recording media can be heightened. In addition, because the even out blade is disposed in a trailing direction against the movement direction of the image support body surface, a possibility of drive torques of the image support body 2Y becoming excessively large can be prevented.

[Embodiment 1 ]

A 40 wt % ABS resin (GR-3000, made by Denki Kagaku Kogyo K. K.) and a 60 wt % polyether-ester amide (IRGASTAT P18, made by Chiba Specialty Chemicals Corp.) are blended as a resin composition. 4 parts of polycarbonate-glycidyl methacrylate-styrene-acrylonitrile copolymer (MODIPER-CL440-G, NOF corp.) is added to 100 parts of the resin composition for fusion and mixing so that a resin fusion composition can be obtained. Then the resin fusion composition is injection molded onto a support body (10 mm external diameter) constituted from a SUM 22 (processed with Ni metallizing plating) to form an electrical resistance adjustment layer. The electrical resistance adjustment layer is performed gate cut and length adjustment. After which a ring shaped spacing member constituted from high density polyethylene resin (NOVATEC-PP HY540, made by Japan Polypropylene Corp.) is press fitted to both end parts of the electrical resistance adjustment layer. A roller is obtained by simultaneously cutting an external diameter of the spacing member to 12.54 mm and an external diameter of the electrical resistance adjustment part to 12.40 mm. Next, a coating compound of a resin composition constituted from acryl-silicone resin (3000VH-P, made by Kawakami Paint Corp.), polyether-polyol resin (Exenol E540, quantity of ethylene oxide is 40 wt %, Asahi Glass Corp.), isocyanate resin (T4 hardening agent, made by Kawakami Paint Corp.), bis (trifluoromethane) sulfonyl imide acid lithium acetic acid butyl solution (made by Sanko Chemical Industry Corp.) and organic salt catalyst (U-CAT SA1, made by SAN-APRO LIMITED) is diluted by a diluting solvent constituted from butyl acetate, toluene and MEK. The coating compound then forms a surface layer of a film thickness of about 10 μm on the surface of the electrical resistance adjustment layer in the roller by spray coating. Next, the surface layer is heated for 90 minutes in an air-heating furnace at 105° C. and hardened. As a result, a roller shaped charging member with an about 70 μm difference formed between the spacing member and the surface layer is obtained.

[Embodiment 2 ]

A charging member is obtained in the same way to the embodiment 1 except the coating compound is of a resin composition constituted from acryl silicone resin (3000VH-P, made by Kawakami Paint Corp.), polyether-polyol resin (Exenol E230, quantity of ethylene oxide is 40 wt %, Asahi Glass Corp.), isocyanate resin (T4 hardening agent, made by Kawakami Paint Corp.), trifluoromethane-sulfone acid lithium solution (made by Sanko Chemical Industry Corp.) and organic salt catalyst (U-CAT SA1, made by SAN-APRO LIMITED).

[Embodiment 3 ]

A charging member is obtained in the same way to the embodiment 1 except the coating compound is of a resin composition constituted from fluorine series resin (Surfcure DSC-201, made by Daido Toryo K.K.), polyether-polyol resin (Exenol E540, quantity of ethylene oxide is 40 wt %, Asahi Glass Corp.), isocyanate resin (T4 hardening agent, made by Kawakami Paint Corp.), bis (trifluoromethane) sulfonyl imide acid lithium acetic acid butyl solution (made by Sanko Chemical Industry Corp.), organic salt catalyst (U-CAT SA1, made by SAN-APRO LIMITED) and another organic salt catalyst (U-CAT SA102, made by SAN-APRO LIMITED).

[Embodiment 4 ]

A charging member is obtained in the same way to the embodiment 1 except the coating compound is of a resin composition constituted from acryl silicone resin (3000VH-P, made by Kawakami Paint Corp.), polyether-polyol resin (Exenol E540, quantity of ethylene oxide is 40 wt %, Asahi Glass Corp.), isocyanate resin (T4 hardening agent, made by Kawakami Paint Corp.), his (trifluoromethane) sulfonyl imide acid lithium acetic acid butyl solution (made by Sanko Chemical Industry Corp.) and organic salt catalyst (U-CAT SA1, made by SAN-APRO LIMITED).

COMPARATIVE EXAMPLE 1

A charging member is obtained in the same way to the embodiment 1 except the coating compound is of a resin composition constituted from acryl silicone resin (3000VH-P, made by Kawakami Paint Corp.), isocyanate resin (T4 hardening agent, made by Kawakami Paint Corp.) and carbon black.

COMPARATIVE EXAMPLE 2

A charging member is obtained in the same way to the embodiment 1 except the coating compound is of a resin composition constituted from acryl silicone resin (3000VH-P, made by Kawakami Paint Corp.), polyol resin including lithium perchlorate (PEL20A, made by Japan Carlit Corp.), isocyanate resin (T4 hardening agent, made by Kawakami Paint Corp.) and lithium peroxide.

With regard to the charging member (charging roller) obtained in the above described embodiment 1 through 4 and comparison example 1 through 2, their electrolyte salt ratio (wt %) and polyether resin ratio as well as a containing ratio of EO (ethylene oxide) are measured. Then the charging members (charging rollers) obtained in the embodiment 1 through 4 and the comparison example 1 through 2 are set to a charging device illustrated in FIG. 4 and 1×1 halftone images are outputted in A3 at 600 dpi using an image forming apparatus (ImagioMP C450) illustrated in FIG. 3. At the moment, as impressed voltage to the charging roller, an AC voltage (Vpp) is gradually lowered from 2.7 kV to 2.2 kV by a unit of 0.1 kV and image output is performed. An Evaluation is made to voltages at which abnormal discharges (white spot) are generated. The evaluation is set as an abnormal discharge safety margin. As other conditions, impressed DC voltage (Vdc) is set to −690V and alternate current frequency is set to 1.5 kHz. In addition, an environment of evaluation is set to 10° C. and 15% RH. In the environment of evaluation, the charging members and the image forming apparatus are humidity conditioned for 24 hours after which evaluations of the charging members and the image forming apparatus are performed.

The EO (ethylene oxide) containing ratio is measured based on an ethylene oxide quantitative estimation method described hereinbelow. That is, IH-spectral of polyether-polyol is measured by a NMR (nuclear magnetic resonance spectroscopic method). Then the containing ratio of ethylene oxide is calculated by peak area ratios in the vicinity of 1.14, 3.54 and 3.66 ppm of the NMR spectral. If peak areas exist in $CH_3$ of propylene oxide (in the vicinity of 1.14 ppm), $CH_2$— (in the vicinity of 3.41 ppm), CH of methine hydrogen (in the vicinity of 3.5 ppm) and $CH_2$ of ethylene oxide (in the vicinity of 3.66 ppm), then it can be determined as a polyether polyether of propylene oxide and ethylene oxide. Then the containing ratio of ethylene oxide is calculated by peak area ratios in the vicinity of 1.14, 3.54 and 3.66 ppm of the NMR spectral. A peak area is calculated by vertically dividing a peak. Measurement is performed using the nuclear magnetic resonator of JEOL JNM-A400FT NMR SYSTEM made by JEOL corp. In addition, a total evaluation standard is classified into O: with no problems in practical use and x: not suited for practical use.

A measurement result is illustrated in the next table 1.

TABLE 1

| | Electrolyte salt ratio (wt %) | Polyether resin ratio | EO containing ratio (wt %) | Voltage at which abnormal discharge (white spot) is generated | Total Evaluation |
|---|---|---|---|---|---|
| Embodiment 1 | 5.5 | 55 | 44 | No generations at 2.2 kV | ○ |
| Embodiment 2 | 5.5 | 55 | 16 | No generations at 2.2 kV | ○ |
| Embodiment 3 | 5.5 | 45 | 20 | No generations at 2.2 kV | ○ |
| Embodiment 4 | 5.5 | 35 | 44 | No generations at 2.2 kV | ○ |
| Comparison Example 1 | 25* | — | 0 | Generations at 2.5 kV | X |
| Comparison Example 2 | 5.5 | 50 | 15 | Generations at 2.5 kV | X |

*Weight ratio of carbon black

According to the present invention, the charging member includes the electrically conductive support body, the electrical resistance adjustment layer disposed on the electrically conductive support body, the surface layer disposed on the electrical resistance adjustment layer in which the surface layer contains at least (a) polyol resin grafted with fluorine or silicon, (b) polyether polyol resin, (c) organic anion salt containing fluorine as well as alkali metal or alkali earth metal and (d) polyisocyanate. Therefore, the charging member can have a low electrical resistance so that even with a wide minute gap between the image support body and the charging member, the charging member that is unlikely to abnormally discharge can be provided.

According to the present invention, the polyether polyol resin is contained in a ratio of 30 through 60 wt % against all resins constituting the surface layer. Therefore, the charging member can have a further low electrical resistance so that even with a wide minute gap between the image support body and the charging member, the charging member that is further unlikely to abnormally discharge can be provided.

According to the present invention, the containing quantity of polyether in the form of ethylene oxide in the polyether polyol resin is 10 through 40 wt %. Therefore, the charging member can have a further low electrical resistance so that even with a wide minute gap between the image support body and the charging member, the charging member that is further unlikely to abnormally discharge can be provided. In addition, in the case of a resin with a large containing quantity of polyether, a polyether resin ratio among all resins can possibly be lowered so that a film coating strength of the surface layer can be heightened.

According to the present invention, the surface layer contains an organic acid salt of a diazabicycloundecene or a diazabicyclononene class and is hardened under the presence of a catalyst constituted from the organic acid salt. Therefore, the hardening reaction is heightened even with a high polyether ratio so that the surface layer with a low electrical resistance can be obtained easily and the charging member that is further unlikely to abnormally discharge can be provided.

According to the present invention, the ring shaped spacing member comes into contact with the image support body and forms a predetermined minute gap thereof. Besides, the spacing member is disposed at both end parts of the charging member. Therefore, residual substances of toners or the like remaining on the surface of the image support body become further difficult to adhere to the charging device.

According to the present invention, the charging device includes the charging member according to the present invention. Therefore, the charging member can have a low electrical resistance so that even with a wide minute gap between the image support body and the charging member, the charging device that is unlikely to abnormally discharge can be provided.

According to the present invention, the charging device and the image support body are supported integrally and the process cartridge is fixed to a main body of the image forming apparatus to be freely detachable in which the charging device of the present invention is used. Therefore, stable images can be obtained over a long time span. In addition, replacement is simplified because user maintenance is possible.

According to the present invention, the image forming apparatus includes at least the process cartridge according to the present invention, the exposure device that performs exposure on a surface of the image support body to form an electrostatic latent image, the image development device that supplies toner to the electrostatic latent image on the surface of the image support body to visualize the electrostatic latent image and the transfer device that transfers onto a transfer media the visualized image on the surface of the image support body. Therefore, high quality images can be obtained and stable images can be obtained over a long time span.

The above-described embodiment is only a representative embodiment of the present invention. The present invention is not limited to the above-described embodiment. That is, various modifications and changes can be made to the above embodiment within a range not deviating from the scope of the present invention.

What is claimed is:

1. A charging member, comprising:

an electrically conductive support body;

an electrical resistance adjustment layer disposed on the electrically conductive support body;

a surface layer disposed on the electrical resistance adjustment layer, wherein the surface layer contains at least polyol resin grafted with fluorine or silicon, polyether polyol resin, and organic anion salt containing fluorine as well as alkali metal or alkali earth metal, and polyisocyanate.

2. The charging member according to claim 1, wherein the polyether polyol resin is contained in a ratio of 30 through 60 wt % to all resins constituting the surface layer.

3. The charging member according to claim 1, wherein a containing quantity of polyether in the polyether polyol resin is 10 through 40 wt % in terms of ethylene oxide.

4. The charging member according to claim 2, wherein a containing quantity of polyether in the polyether polyol resin is 10 through 40 wt % in terms of ethylene oxide.

5. The charging member according to claim 1, wherein the surface layer contains an organic acid salt of a diazabicycloundecene or a diazabicyclononene class and is hardened under the presence of a catalyst constituted from the organic acid salt.

6. The charging member according to claim 1, comprising:

a ring shaped spacing member that comes into contact with the image support body in order to form a predetermined minute gap thereof, wherein the spacing member is disposed at both end parts of the charging member.

7. A charging device, comprising:

the charging member according to claim 1.

8. A process cartridge, comprising:

a charging device including a charging member comprising:

an electrically conductive support body;

an electrical resistance adjustment layer disposed on the electrically conductive support body; and a surface layer disposed on the electrical resistance adjustment layer, wherein the surface layer contains at least polyol resin grafted with fluorine or silicon, polyether polyol resin, and organic anion salt containing fluorine as well as alkali metal or alkali earth metal, and polyisocyanate, the charging device and an image support body are supported integrally, and the process cartridge is fixed to a main body of an image forming apparatus to be freely detachable.

9. An image forming apparatus, comprising:

an image support body;

a process cartridge including a charging device, the charging device and the image support body being supported integrally, and the charging device including a charging member comprising:

an electrically conductive support body;

an electrical resistance adjustment layer disposed on the electrically conductive support body; and a surface layer disposed on the electrical resistance adjustment layer;

an exposure device that performs exposure on a surface of the image support body to form an electrostatic latent image;

an image development device that supplies toner to the electrostatic latent image on the surface of the image support body to visualize the electrostatic latent image;

a transfer device that transfers onto a transfer media the visualized image on the surface of the image support body, wherein the surface layer contains at least polyol resin grafted with fluorine or silicon, polyether polyol resin, and organic anion salt containing fluorine as well as alkali metal or alkali earth metal, and polyisocyanate.

10. The process cartridge according to claim 8, wherein the polyether polyol resin is contained in a ratio of 30 through 60 wt % to all resins constituting the surface layer.

11. The process cartridge according to claim 8, wherein a containing quantity of polyether in the polyether polyol resin is 10 through 40 wt % in terms of ethylene oxide.

12. The process cartridge according to claim 8, wherein the surface layer contains an organic acid salt of a diazabicycloundecene or a diazabicyclononene class and is hardened under the presence of a catalyst constituted from the organic acid salt.

13. The process cartridge according to claim 8, wherein the charging member comprises a ring shaped spacing member that comes into contact with the image support body in order to form a predetermined minute gap thereof, and the spacing member is disposed at both end parts of the charging member.

14. The image forming apparatus according to claim 9, wherein the polyether polyol resin is contained in a ratio of 30 through 60 wt % to all resins constituting the surface layer.

15. The image forming apparatus according to claim 9, wherein a containing quantity of polyether in the polyether polyol resin is 10 through 40 wt % in terms of ethylene oxide.

16. The image forming apparatus according to claim 9, wherein the surface layer contains an organic acid salt of a diazabicycloundecene or a diazabicyclononene class and is hardened under the presence of a catalyst constituted from the organic acid salt.

17. The image forming apparatus according to claim 9, wherein the charging member comprises a ring shaped spacing member that comes into contact with the image support body in order to form a predetermined minute gap thereof; and the spacing member is disposed at both end parts of the charging member.

* * * * *